US011011341B2

(12) United States Patent
Mishin et al.

(10) Patent No.: US 11,011,341 B2
(45) Date of Patent: May 18, 2021

(54) TRANSMISSION TARGET FOR A HIGH POWER ELECTRON BEAM

(71) Applicant: Varex Imaging Corporation, Salt Lake City, UT (US)

(72) Inventors: Andrey V. Mishin, Salt Lake City, UT (US); Levi Madden, Salt Lake City, UT (US); Irina Balantceva, Salt Lake City, UT (US)

(73) Assignee: Varex Imaging Corporation, Salt Lake City, UT (US)

( * ) Notice: Subject to any disclaimer, the term of this patent is extended or adjusted under 35 U.S.C. 154(b) by 0 days.

(21) Appl. No.: 15/985,677

(22) Filed: May 21, 2018

(65) Prior Publication Data

US 2019/0355540 A1 Nov. 21, 2019

(51) Int. Cl.
*H01J 35/08* (2006.01)

(52) U.S. Cl.
CPC ..... *H01J 35/08* (2013.01); *H01J 35/116* (2019.05); *H01J 2235/083* (2013.01)

(58) Field of Classification Search
CPC ..... H01J 2235/083; H01J 2235/086; H01J 35/06; H01J 35/08; H01J 35/116
See application file for complete search history.

(56) References Cited

U.S. PATENT DOCUMENTS 3,867,637 A * 2/1975 Braun ..... G03B 42/026 378/2
3,992,633 A * 11/1976 Braun ..... H01J 35/00 378/2
4,439,870 A * 3/1984 Poulsen ..... H01J 35/08 378/130
4,521,903 A * 6/1985 Braun ..... H01J 35/12 378/141
4,618,972 A * 10/1986 Georgiou ..... H01J 35/12 378/141
4,675,890 A * 6/1987 Plessis ..... H01J 35/08 378/121
8,189,742 B2 * 5/2012 Behling ..... H01J 35/10 378/124
9,269,524 B1 * 2/2016 Le Galloudec ..... H05G 2/00
2004/0165699 A1 8/2004 Rusch
2007/0030958 A1 * 2/2007 Munger ..... H01J 35/16 378/203
2011/0235781 A1 * 9/2011 Aoki ..... H01J 35/08 378/62
2013/0230143 A1 9/2013 Ueda
2019/0298289 A1 * 10/2019 Silver ..... A61B 6/4208

OTHER PUBLICATIONS

Search Report mailed in PCT/US2019/033248 dated Sep. 30, 2019.
Written Opinion mailed in PCT/US2019/033248 dated Sep. 30, 2019.

* cited by examiner

*Primary Examiner* — Marcus H Taningco
(74) *Attorney, Agent, or Firm* — Laurence & Phillips IP Law

(57) ABSTRACT

Some embodiments include a system, comprising: an electron source configured to generate an electron beam along an axis; and a transmission target configured to receive the electron beam, the transmission target, comprising a target material having a surface disposed to receive the electron beam; wherein a majority of the surface is disposed at an angle relative to the axis different from 89 to 91 degrees.

14 Claims, 6 Drawing Sheets

TRANSMISSION TARGET FOR A HIGH POWER ELECTRON BEAM

BACKGROUND

This disclosure relates to transmission targets for high power electron beams.

High power x-ray generators may use a transmission target to convert a high-power electron beam to high power x-rays. The transmission target includes a material that generates bremsstrahlung in response to the high-power electron beam. The material is disposed in a plane perpendicular to the indecent electron beam. Bremsstrahlung, also referred to as "braking radiation" or "deceleration radiation", is electromagnetic radiation produced by the deceleration of a charged particle when deflected by another charged particle.

The incident electron beam heats the material of the transmission target. Higher heat can lead to failures. Increasing the power of the electron beam increases the heat dissipated by the material and hence, increases the chance of failure.

BRIEF DESCRIPTION OF SEVERAL VIEWS OF THE DRAWINGS

FIGS. 2-3A are cross-sections of transmission targets according to some embodiments.

DETAILED DESCRIPTION

Conventionally, an electron beam may be perpendicular to a transmission target surface. As will be described in further detail below, in some embodiments, a transmission target for an x-ray source has a surface disposed at an angle (not approximately 90 degrees (°) or approximately perpendicular to the electron beam) relative to an axis of an incoming electron beam. The electron beam may be a high-power electron beam with energy in a range from about 400 kiloelectronvolt (keV) to about 20 megaelectronvolt (MeV). As a result of the angle of the surface of the transmission target, a power density on the surface of the target may be reduced and/or a higher power electron beam may be used with similar reliability. Reducing the power density reduces the operating temperature and increases the life of the target material used to convert the electron beam to radiation such as bremsstrahlung, x-rays, or the like. As will be described in further detail below, such a transmission target and systems including such a transmission target may be used for various applications, such as security screening (e.g., cargo security screening), non-destructive testing, radiation therapy, material processing, or the like.

Figure 1:
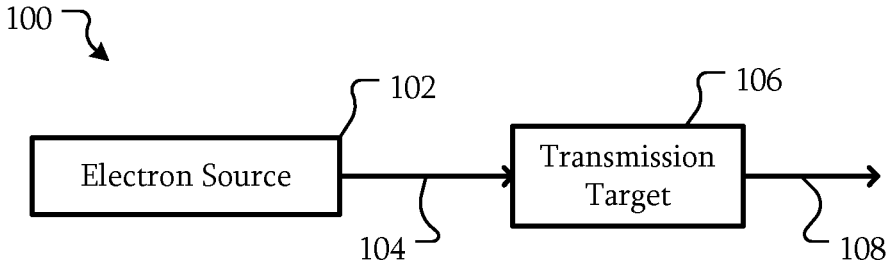
FIG. 1 is a block diagram of a system with a transmission target according to some embodiments.

FIG. 1 is a block diagram of a system with a transmission target according to some embodiments. The system 100 includes an electron source 102 configured to generate an electron beam 104. The electron beam 104 is directed towards a transmission target 106. The electron beam 104 interacts with the transmission target 106 to generate radiation 108. In an example, the radiation, such as x-rays, generated by interaction with the transmission target 106 passes through the target in a similar direction as the direction of the emitted electrons in the electron beam 104. The thickness of the transmission target 106 can be thin enough to allow radiation to pass through a target material and/or any supporting structure for the target material.

In some embodiments, the energy of the electron beam 104 may be on the order of hundreds of kEV, MeV, or more. In some embodiments, an energy of about 6 MeV or greater may cause the resulting radiation 108 to be oriented in a transmission direction rather than deflected or reflected to a side. In some embodiments, the electron beam 104 has an average power in the kilowatt (kW) range. In some embodiments, the electron beam 104 may be pulsed. The power of the pulses may be in the megawatt (MW) range. The electron source 102 may be any device that can generate an electron beam 104 with such energies or powers. As will be described in further detail below, the transmission target 106 may be used with higher energy electron beams 104 than when using a target that has the target material with a surface angled to the electron beam that generates radiation orthogonal to the electron beam 104. In addition, the transmission target 106 may be used with higher energy electron beams 104 as the power density on the surface of the target material may be reduced due to the surface of the target material being angled relative to the electron beam to be at an angle other than orthogonal or 90 degrees. For example, the angle may be different from about 89 to about 91 degrees.

In some embodiments, using a transmission target as described herein may preclude using a rotating target. Typically, a rotating target requires additional space for the rotating mechanism and a collimator. Such structures are may be omitted as a transmission target 106 as described herein has a reduced power density on the surface of the transmission material.

A variety of examples of transmission targets 106 will be described below.

Figure 2:
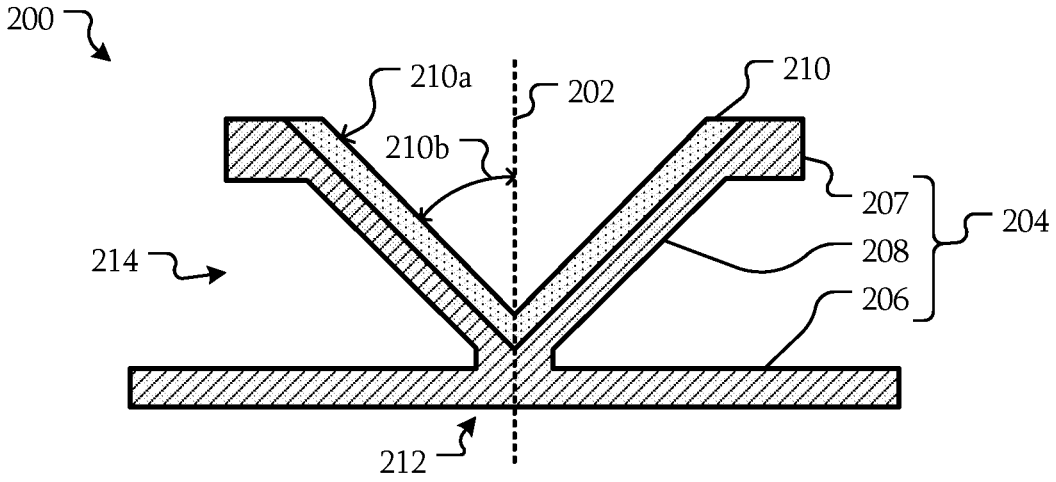
Figure 3A:
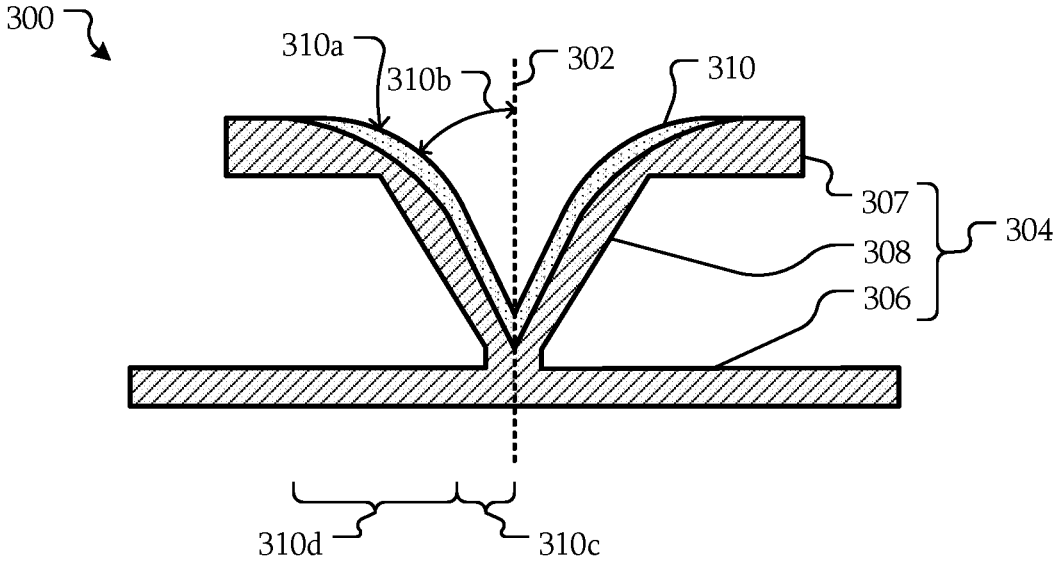
Figure 3B:
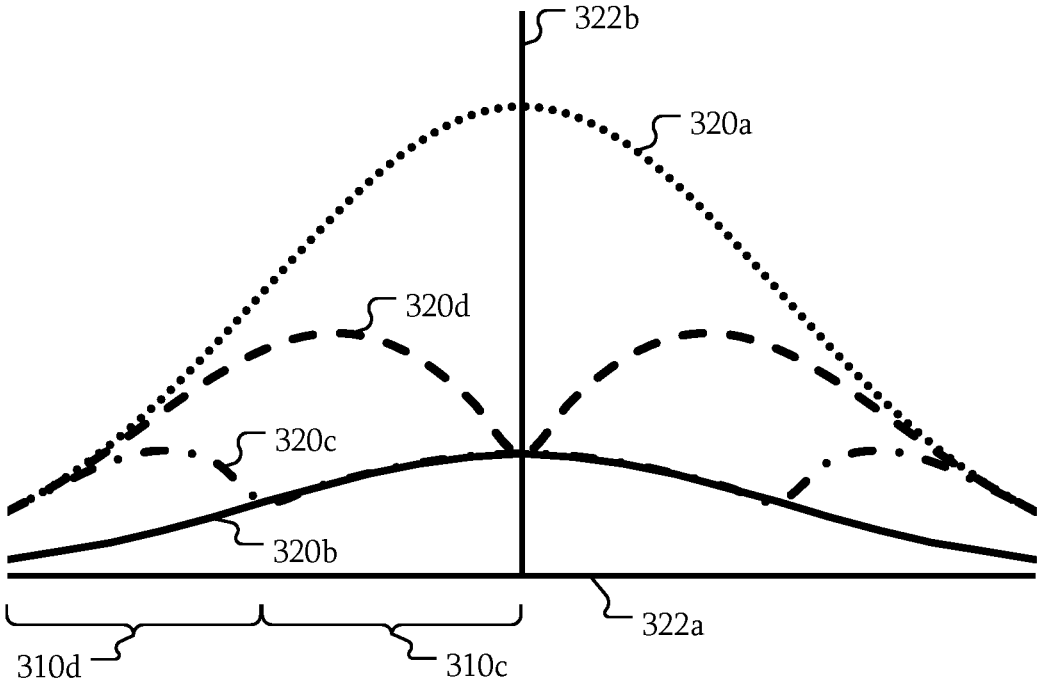
FIG. 3B is a chart illustrating examples of a power distribution of an electron beam incident on the transmission target of FIG. 3A.
Figure 4:
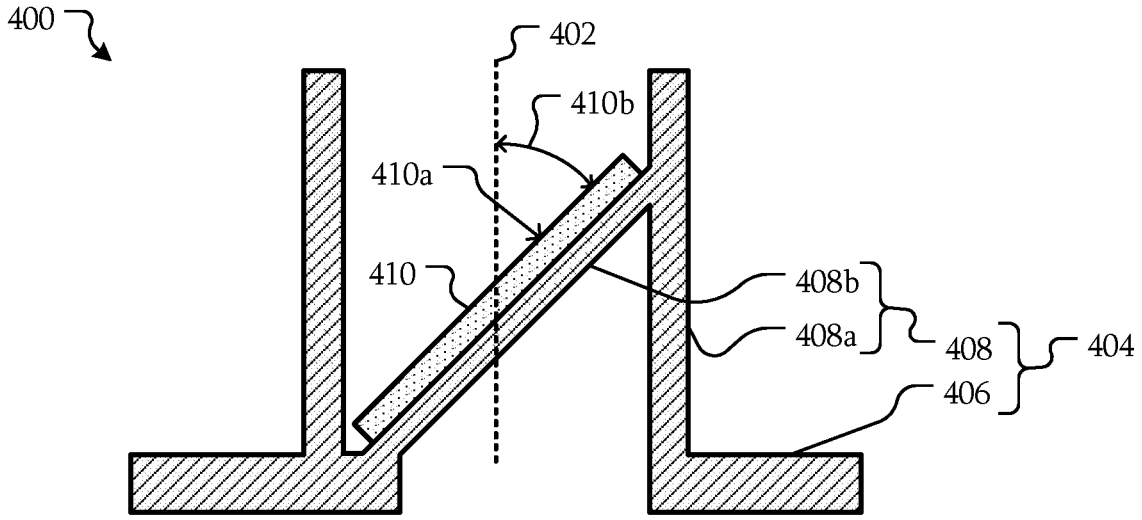
FIG. 4 is a cross-section of a planar transmission target according to some embodiments.

FIGS. 2-4 are cross-sections of transmission targets according to some embodiments. Referring to FIG. 2, the transmission target 200 is disposed about an axis 202. The axis 202 is an axis of an incoming electron beam in operation. For example, the electron beam 104 of FIG. 1 may be generated by the electron source 102 along the axis 202.

The transmission target 200 includes a target structure 204 and a target material 210 attached to the target structure 204. The target material 210 may include any material that may convert incoming electrons to radiation. For example, the target material may include tungsten, rhenium, molybdenum, rhodium, other heavy metals, high-Z material, or the like. A high-Z material is chemical element with a high atomic number (Z) of protons in the nucleus. In some embodiments, the target material 210 is a material that generates x-rays in response to incident electrons. The target material 210 may be attached to the target structure 204 in a variety of ways. For example, the target material 210 may be deposited on the target structure 204. In other embodiments, the target material may be brazed to the target structure 204. In other embodiments, the target material 210 may be attached and/or formed on the target structure 204 in a manner suitable for operation as a target for a high-power electron beam given the materials of the target material 210 and the target structure 204.

The target structure 204 includes a base 206 and a wall 208. In some embodiments, the target structure 204 also includes a flange 207. The base 206 extends radially from the axis 202. In some embodiments, the wall 208 extends at an angle both radially and axially from the axis 202. The base 206 may include other structures for attaching the transmission target 200 to a housing or other structure containing the transmission target 200.

The base 206 and the wall 208 may have a thickness and material selected to reduce absorption of radiation. For example, the base 206 and the wall 208 may be formed of copper. The wall 208 may have a thickness that is about 0.01 inches (in) or 0.25 millimeters (mm). The base 206 may have a thickness that is about 0.04 in or 1.0 mm. However, in other embodiments, the material and thicknesses may be different.

The flange 207 may extend radially from the axis 202. Both the base 206 and the flange 207 may be configured to attach the transmission target 200 to a housing or other structure containing the transmission target 200.

The target material 210 may be disposed or brazed onto the wall 208. The target material 210 has a surface 210*a* that is disposed to receive an electron beam in use. The surface 210*a* has a majority of the area disposed at an angle 210*b* relative to the axis 202. In some embodiments, the angle 210*b* is disposed at an angle 210*b* that is less than 70 degrees. In some embodiments, the angle 210*b* is disposed at an angle 210*b* that is less than 50 degrees. In some embodiments, the angle is between about 7.5 degrees and about 15 degrees.

The angle 210*b* of the surface 210*a* affects the power density applied to the target material 210. For example, for an electron beam 104 with a uniform power distribution, that power would be spread over an area equivalent to the spot area of the electron beam 104 on a flat target. However, because at least part of the surface 210*a* of the target material 210 is disposed at an angle 210*b*, the effective spot area is increased. For example, the effective spot area may be increased by $1/\sin(\theta)$ where $\theta$ is the angle 210*b*. In some embodiments, the angle 210*b* is about 15 degrees, leading to a doubling of the effective spot area. In other embodiments, the angle 210*b* is about 7.5 degrees, leading to an increase in the effective spot area by a factor of about 3.9.

The increase in the effective spot area can increase reliability and/or power handling capability. For example, with the same power of the electron beam 104, the incident power density is reduced when the surface 210*a* is disposed at an angle, resulting in reduced temperatures and increased reliability. In another example, the power of the electron beam 104 may be increased until the incident power density is similar to that of a flat target at the lower power. As a result, a higher power may be used at a similar reliability. This higher power may be a higher average power, a higher pulsed power, a higher pulse duty cycle, or the like.

In some embodiments, a power density at region 212 may be a local maximum as the angle of the surface 210*a* transitions to the opposite side of the axis 202. Here, the change is illustrated as immediate; however, the change may occur over a finite distance. As a result, heat may be concentrated as this region 212. In some embodiments, a thickness of the target structure 204 may be greater in this region to aid in heat dissipation. For example, the overall thickness of the target structure 204 at region 212 may be about 8% greater than the thickness of the base 206 and the wall 208 in other regions. In other embodiments, overall thickness of the target structure 204 at region 212 may be about 8% to about 10% greater than the thickness of the base 206 and the wall 208 in other regions. In other embodiments, overall thickness of the target structure 204 at region 212 may be about 4 to about 20% greater than the thickness of the base 206 and the wall 208 in other regions. In other embodiments, the thickness of the target structure 204 may be greater in this region 212 by an amount that, in operation, causes a maximum temperature in the region 212 to be less than a threshold above which the target material 210 may delaminate, deform, or otherwise change in a manner that changes the operating characteristics at a temperature below the maximum temperature.

In some embodiments, the transmission target 200 may include an opening 214 between a portion of the transmission target 200 including the target material 210 and the base 206. For example, the opening 214 is disposed axially between the wall 208 and the base 206. As a result, less radiation generated in the target material travelling in an axial direction may be absorbed than if the opening 214 was filled with a structural material.

Referring to FIG. 3A, the transmission target 300 may be similar to the transmission target 200 described above. However, the transmission target 300 includes a target material 310 that has a surface 310*a* that varies based on distance from the axis 302. In particular, the angle 310*b* of the surface 310*a* of the target material 310 increases as the distance of the surface 310*a* from the axis 302 on at least part of the surface 310*a* increases, forming a curved surface as seen in cross section. In some embodiments, for the majority of the surface 310*a*, the angle 310*b* increases as the distance from the axis 302 increases. In this example, in region 310*c*, the surface 310*a* has a constant angle 310*b* versus distance from the axis 302. In region 310*d*, the surface 310*a* has an increasing angle 310*b* versus desistance from the axis 302. However, in other embodiments, more of the surface 310*a* or the entire surface 310*a* may vary according to the distance from the axis 302. The angle 310*b* can have the same range as the angle 210*b* in FIG. 2 (where the angle increases to 90 degrees as the distance from the axis 302 increases). For example, in the region 310*c*, the angle 310*b* may be a constant angle similar to the angles 210*b* described with respect to FIG. 2.

FIG. 3B is a chart illustrating examples of a power distribution of an electron beam incident on the transmission target 300 of FIG. 3A. Referring to FIGS. 2, 3A, and 3B, the axis 322*a* is the distance from the axis 302 and the axis 322*b* is the relative power density. Curve 320*a* represents the incident power density. For example, curve 320*a* may represent the power density incident on a transmission target having a surface having an angle that is 90 degrees relative to the axis 302. In this example, the power density may have a gaussian power distribution (e.g., symmetric "bell curve" shaped distribution) as illustrated, but in other embodiments, the power density distribution may be different. The power density may be a maximum along the axis 302. Radially outward from the axis 302, the power decreases.

Three other power densities 320*b*, 320*c*, and 320*d* are illustrated as examples. Power density 320*b* represents a target material 210 having a surface 210*a* with constant angle 210*b*, such as 15 degrees, as illustrated in FIG. 2. Accordingly, the power density 320*b* is reduced by a factor of $\sin(15°)$. The power density 320*b* has been reduced by a constant and thus, retains the same or similar variation versus distance from the axis 202.

Power density 320*c* represents a target material 310 having a surface 310*a* with a constant angle 310*b*, such as 15 degrees, in region 310*c* and a varying angle 310*b* in region 310*d*. Accordingly, the power density 320*c* has been reduced by a constant in region 310*c* and reduced by a varying amount in region 310*d*. As a result, the variation in power density 320*c* has been reduced relative to the incident power density 320*a*.

Power density 320*d* represents a target material 310 having a surface 310*a* with an angle 310*b* that varies across the entire surface 310*a*. In the examples of power densities 320*b*-320*d*, the values close to the axis 302 may be idealized values. In some embodiments, the power density near the axis 302 may approach the incident power density of curve 320*a* due to manufacturing tolerances.

As the power decreases, the angle 310*b* of the corresponding surface 310*a* of the target material 310 may increase, including increasing up to 90 degrees. As a result, a radial variation in the intensity on the surface 310*a* may be reduced.

As described above, the electron beam power density may have a gaussian distribution. Accordingly, the angle 310*b* of the surface 310*a* may be based on a gaussian distribution. However, in other embodiments, the power distribution of the electron beam may be different and the variation of the surface may be correspondingly different.

While in some embodiments, the entirety of the angle 310*b* may be based on the expected power distribution, in other embodiments, only some of the angle 310*b* may be based on the expected power distribution. In addition, while a surface 310*a* or portions of the surface 310*a* have been illustrated with a continuously varying angle 310*b*, in other embodiments, the angle 310*b* may change in other manners. For example, the angle 310*b* may change in discrete steps versus distance from the axis 302.

FIG. 4 is a cross-section of a planar transmission target according to some embodiments. The transmission target 400 includes structures similar to those of FIGS. 2 and 3A. However, the transmission target 400 includes a planar target material 410 having a planar surface 410*a* disposed at an angle 410*b*. The transmission target 400 includes a target structure 404 surrounding the target material 410.

In some embodiments, the target structure 404 includes a base 406 and a cylindrical structure 408 including a wall 408*a* and a plate 408*b*. The wall 408*a* extends axially. The plate 408*b* is disposed at an angle and attached to the wall 408*a*. The base 406 extends radially outward from the wall 408*a*.

The planar target material 410 is disposed or brazed on the plate 408*b* within the cylindrical structure 408. Accordingly, the planar target material 410 is also disposed at an angle relative to the axis 402. The angle 410*b* can have the same range as the angle 210*b* in FIG. 2.

The plate 408*b* may have a relatively thin thickness similar to the wall 208 described above. As a result, radiation generated by the target material 410 may experience less absorption when passing through the plate 408*b*. For example, the plate 408*b* may have a thickness of about 0.01 in. or 0.25 mm.

Figure 5A:
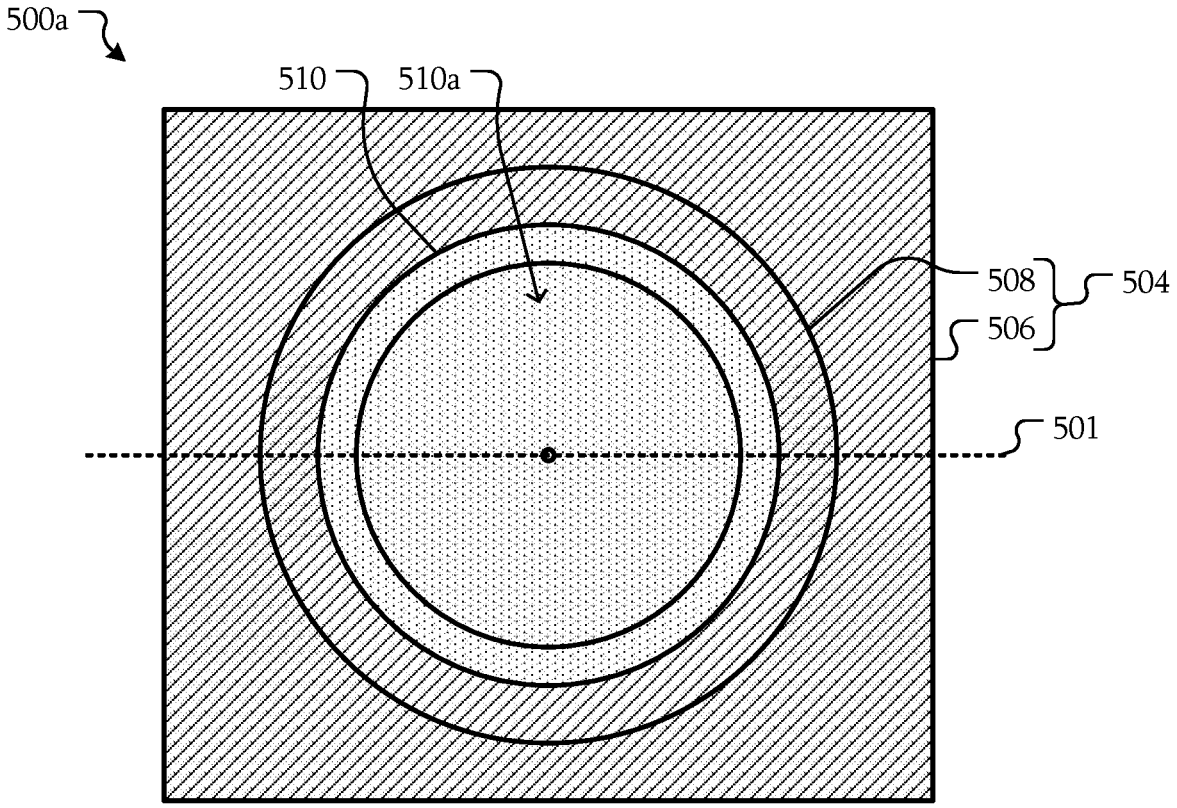
FIGS. 5A, 5B, and 6 are top views of transmission targets according to some embodiments.
Figure 5B:
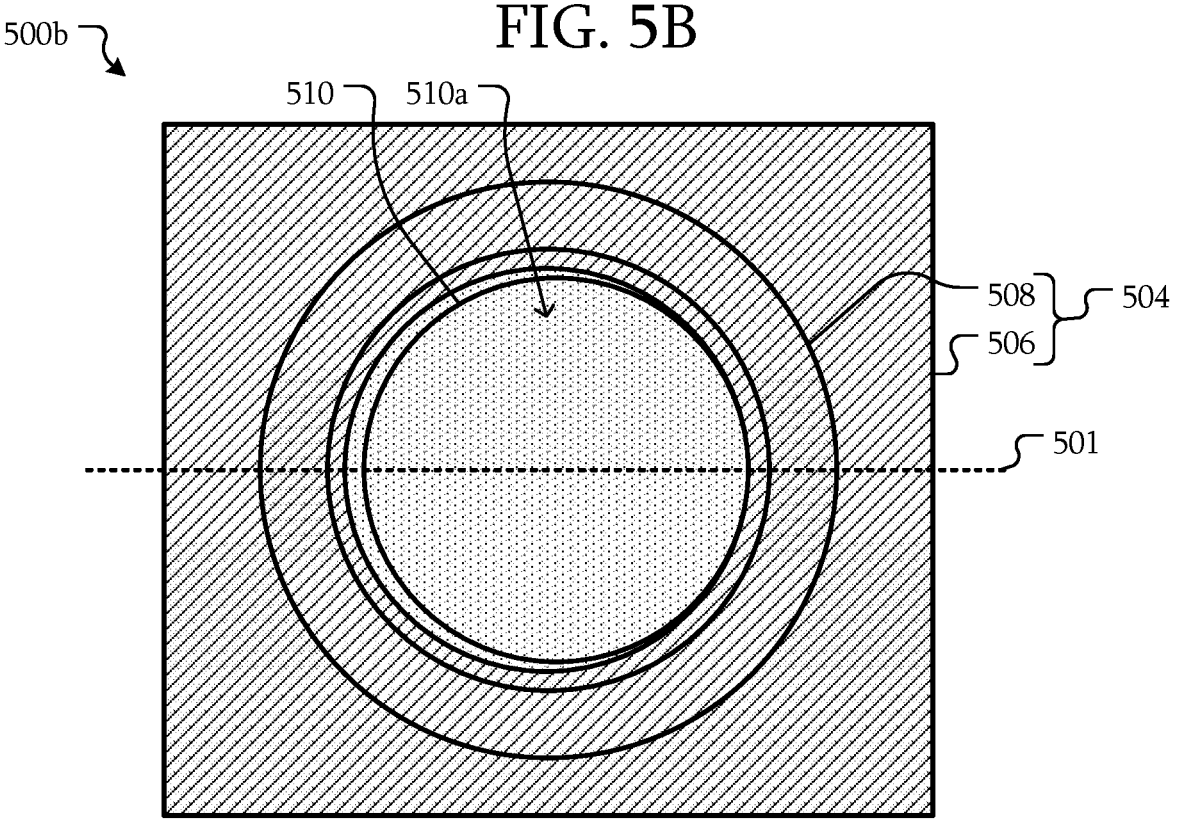
Figure 6:
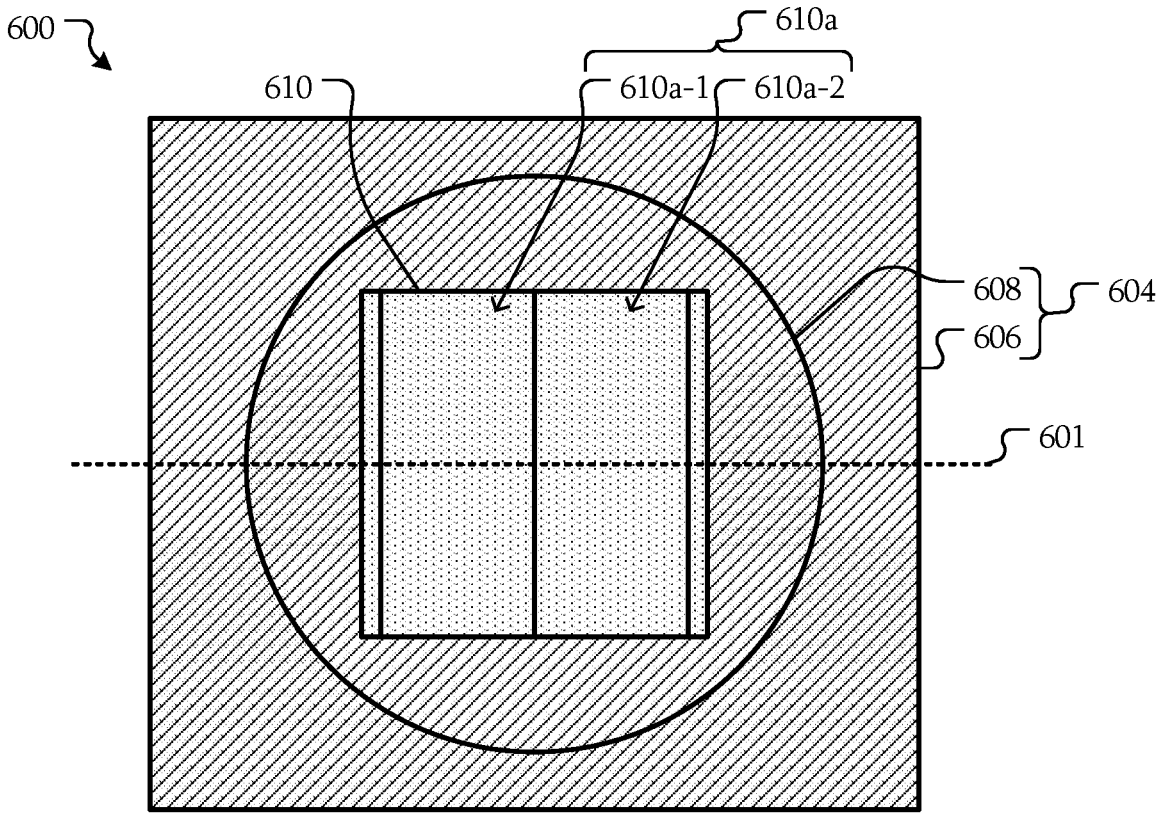

FIGS. 5A, 5B, and 6 are top views of transmission targets according to some embodiments. Referring to FIG. 5, the transmission target 500*a* has the cross-section similar to that of FIG. 2 along plane 501. The transmission target 500*a* has a target structure 504 including a base 506 and wall 508, and a target material 510 with a surface 510*a* similar to the corresponding structures of the transmission target 200 of FIG. 2. Here, the wall 508 and the target material 510 have conical structures. The conical structure of the target material 510 is nested in the conical structure of the wall 508. The surface 510*a* of the target material 510 is an inner surface of the conical structure. Accordingly, the surface 510*a* is a concave conical structure. The transmission target 500*a* can have a cross-section similar to that of FIG. 3A along plane 501. Referring to FIG. 5B, in some embodiments, the transmission target 500*b* may be similar to that of transmission target 500*a* of FIG. 5A. However, the transmission target 500*b* may have a cross-section similar to that of FIG. 4 along plane 501.

Referring to FIG. 6, the transmission target 600 has a cross-section similar to that of FIG. 2 along plane 601, the transmission target 600 has a target structure 604 including a base 606 and wall 608, and a target material 610 with a surface 610*a* similar to the transmission target 200 of FIG. 2. Here, the wall 608 may have a generally cylindrical structure. However, an interior surface of the wall 608 may have a rectangular cross-section.

The surface 610*a* of the includes multiple planes. Here, the surface 610*a* includes two major planes 610*a*-1 and 610*a*-2. Each of these planes 610*a*-1 and 610*a*-2 is disposed at an angle relative to the major axis for the structure similar to axis 202 of the cross-section of FIG. 2. Each of these planes 610*a*-1 and 610*a*-2 is disposed at an angle relative to the major axis for the structure similar to axis 202 of the cross-section of FIG. 2. Although two planes 610*a*-1 and 610*a*-2 have been used as an example, in other embodiments more planes, a continuously varying surface 610*a*, or the like may be present similar to the surface 310*a* of the cross-section of FIG. 3.

In some embodiments, a transmission target may have a top view similar to that of FIG. 6, but a cross-section similar to that of FIG. 4. Accordingly, the target material 610 may include only one plane 610*a*-1 that extends across the rectangular opening.

In the variety of transmission targets described above, the target material has been illustrated as extending to be coincident with edges, surfaces, or the like of a target structure, wall, plate, or the like. However, in other embodiments, the target material may extend to different positions. For example, the target material 210 of FIG. 2 may be recessed within the wall 208 or extend outward over the wall 208. In another example, the target material 410 of FIG. 4 may extend to the axially extending portions of the wall 408*a*.

Figure 7:
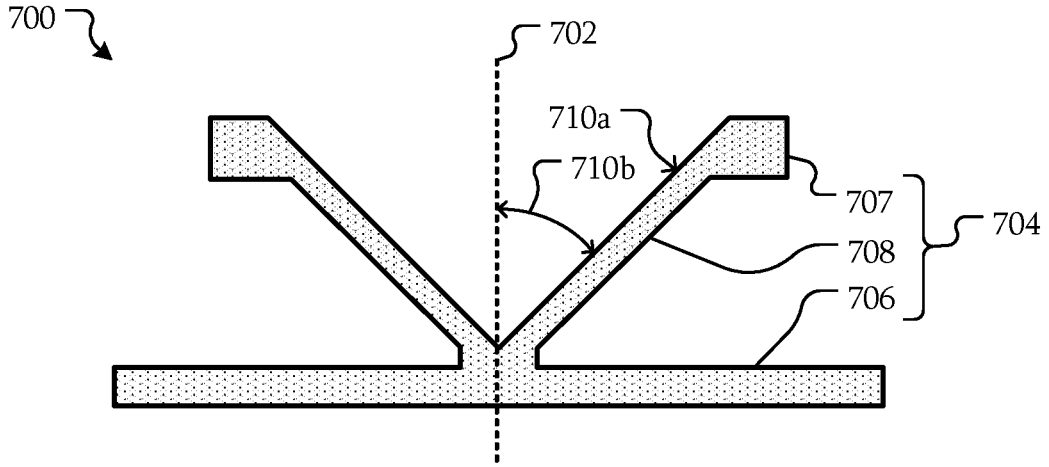
FIG. 7 is a cross-section of transmission target having a single material according to some embodiments.

FIG. 7 is a cross-section of transmission target having a single material according to some embodiments. The transmission target 700 has a target structure 704 including a base 706, flange 707, and wall 708, and a surface 710*a* similar to the corresponding structures of FIG. 2. However, the transmission target 700 is formed of a single material. The single material is a material suitable to be a target material. For example, tungsten may have sufficient structural properties to support the transmission target 700 structure itself during operation.

In some embodiments, the base 706 may be formed of the same target material. However, in other embodiments, only the wall 708 may be formed of the target material.

Although the cross-section of FIG. 2 has been used as an example of a structure that may be entirely or partially formed with the target material, other transmission targets described herein may be formed entirely or partially with the target material.

Figure 8:
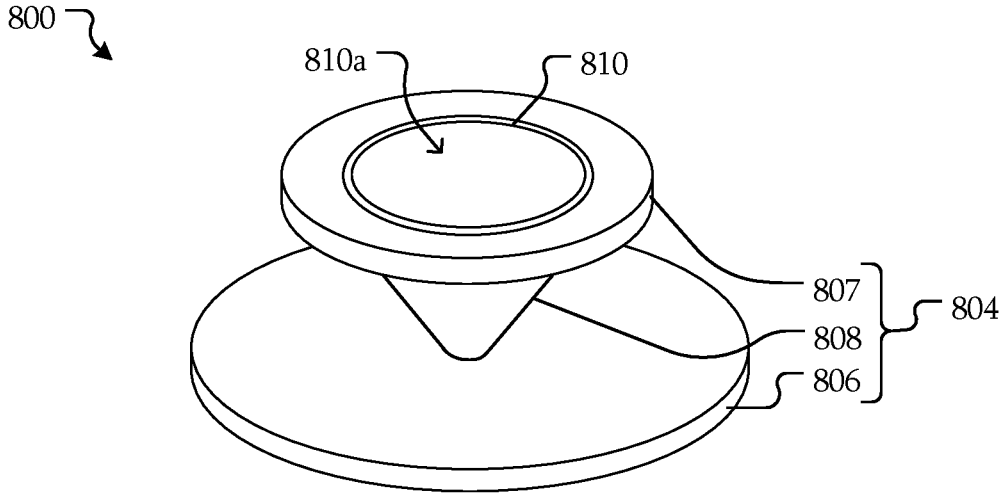
FIG. 8 is an orthographic projection of a transmission target according to some embodiments.

FIG. 8 is an orthographic projection of a transmission target according to some embodiments. The transmission target 800 is an example of a transmission target that has a cross-section similar to that in FIG. 2 and a top view similar to that of FIG. 5. The target structure 804 including the base 806, flange 807, and wall 808, target material 810 having a surface 810*a* may be similar to the corresponding structures described in FIGS. 2 and 5.

Referring back to FIG. 1, in some embodiments, a system 100 may include a transmission target 106 that corresponds to a beam shape of the electron beam 104. For example, if the electron beam 104 has a broader cross-section in a first direction and a narrower cross-section in a second, orthogonal direction, the transmission target 106 may include a transmission target such as the transmission targets 400 of FIG. 4, 500*b* of FIG. 5B, 600 of FIG. 6, or the like. The first direction of the electron beam 104 may be aligned with the cross-section of FIG. 4 or the plane 601 of FIG. 6. Such a system 100 may be used in security screening, cargo scanning, or the like.

In other embodiments, electron beam 104 of the system 100 may have an angularly symmetric cross-section. The transmission target 106 may include a transmission target such as the 200 of FIG. 2, 300 of FIG. 3A, 500*a* of FIG. 5A, or the like. Such transmission targets 106 may have corresponding angular symmetry. Such a system 100 may be used in non-destructive testing or other applications.

Figure 9:
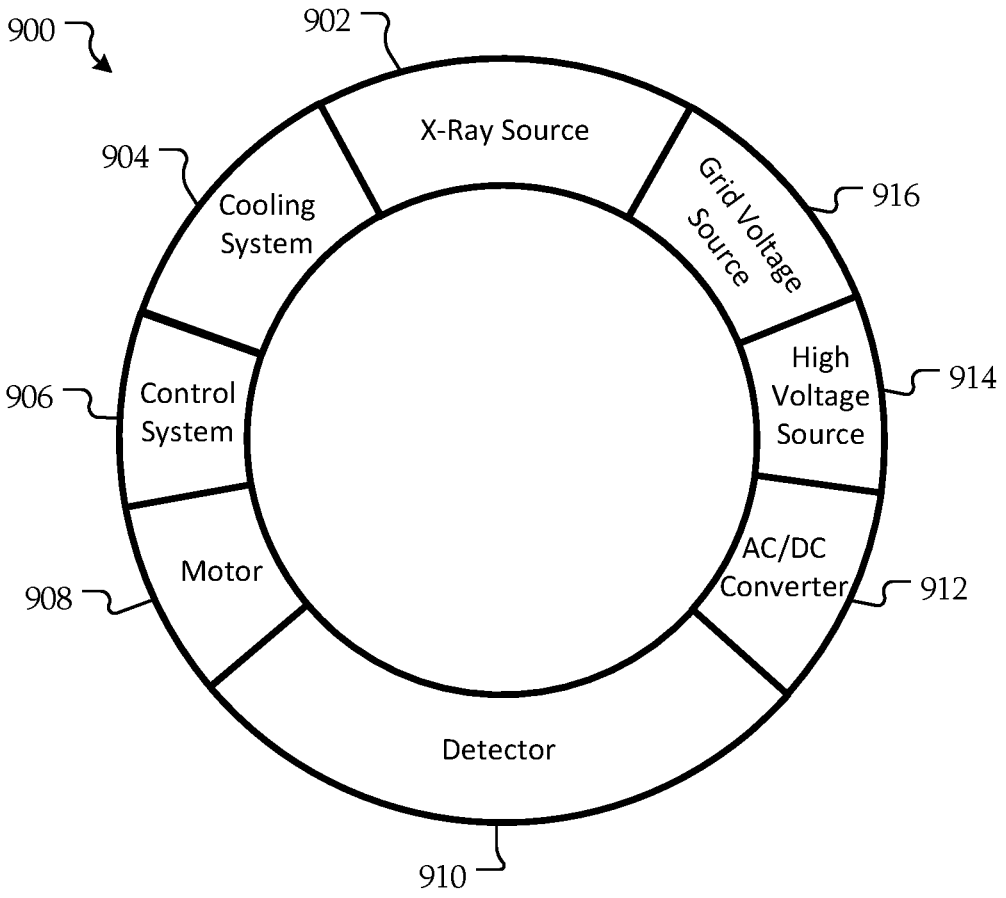
FIG. 9 is a block diagram of a computerized tomography (CT) gantry according to some embodiments.

FIG. 9 is a block diagram of a computerized tomography (CT) gantry according to some embodiments. In some embodiments, the CT gantry includes an x-ray source 902, a cooling system 904, a control system 906, a motor drive 908, a detector 910, an AC/DC converter 912, a high voltage source 914, and a grid voltage source 916. The x-ray source 902 may include transmission target as described above. Although particular components have been used as examples of components that may be mounted on a CT gantry, in other embodiments, the other components may be different. Although a CT gantry is used as an example of a system that includes a high voltage structure as described herein, high voltage structure described herein may be used in other types of systems.

Figure 10:
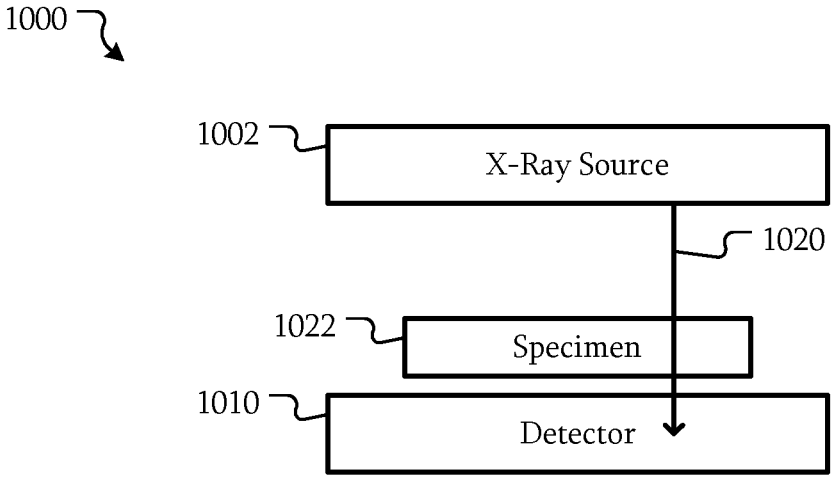
FIG. 10 is a block diagram of a 2D x-ray imaging system according to some embodiments.

FIG. 10 is a block diagram of a 2D x-ray imaging system according to some embodiments. The imaging system 1000 includes an x-ray source 1002 and a detector 1010. The x-ray source 1002 may include a transmission target as described above. The x-ray source 1002 is disposed relative to the detector 1010 such that x-rays 1020 may be generated to pass through a specimen 1022 and detected by the detector 1010.

Referring to FIGS. 1-8, some embodiments include a system, comprising: an electron source 102 configured to generate an electron beam 104 along an axis 202, 302, 402, or 702; and a transmission target 200, 300, 400, 500, 600, 700, or 800 configured to receive the electron beam 104, the transmission target 200, 300, 400, 500, 600, 700, or 800, comprising a target material 210, 310, 410, 510, 610, 700, or 810 having a surface 210*a*, 310*a*, 410*a*, 510*a*, 610*a*, 710*a*, or 810*a* disposed to receive the electron beam 104; wherein a majority of the surface 210*a*, 310*a*, 410*a*, 510*a*, 610*a*, 710*a*, or 810*a* is disposed at an angle 210*b*, 310*b*, 410*b*, 510*b*, 610*b*, or 710*b* relative to the axis 202 that is different from 89 to 91 degrees.

In some embodiments, the majority of the surface 210*a*, 310*a*, 410*a*, 510*a*, 610*a*, 710*a*, or 810*a* is disposed at an angle 210*b*, 310*b*, 410*b*, 510*b*, 610*b*, 710*b*, or 810*b* relative to the axis 202, 302, 403, or 702 that is less than 70 degrees.

In some embodiments, the transmission target 200, 300, 500, 700, or 800 has a conical structure and the surface 210*a*, 310*a*, 510*a*, 710*a*, or 810*a* is an inner surface 210*a*, 310*a*, 510*a*, 710*a*, or 810*a* of the conical structure.

In some embodiments, the angle 210*b*, 310*b*, 510*b*, 610*b*, 710*b*, or 810*b* of the surface 210*a*, 310*a*, 510*a*, 610*a*, 710*a*, or 810*a* of the transmission target 200, 300, 500, 600, 700, or 800 increases as the distance of the surface 210*a*, 310*a*, 510*a*, 610*a*, 710*a*, or 810*a* from the axis 202, 302, 702, or 802 increases.

In some embodiments, the transmission target 400 or 600 further comprises a cylinder 408*a*, 508, or 608 surrounding the target material 410, 510, or 610.

In some embodiments, the surface 410*a* or 610*a* comprises at least one plane.

In some embodiments, the transmission target 200, 300, 500, 600, 700, or 800 comprises: a radially extending base 206, 306, 506, 606, 706, or 806; and an opening between a portion of the transmission target 200, 300, 500, 600, 700, or 800 including the target material 210, 310, 510, 610, 710, or 810 and the base 206, 306, 506, 606, 706, or 806.

In some embodiments, the transmission target 200, 300, 400, 500, 600, 700, or 800 is entirely formed of the target material 210, 310, 410, 510, 610, 710, or 810.

In some embodiments, the transmission target 200, 300, 400, 500, 600, 700, or 800 comprises: a first conical structure including the target material 210, 310, 510, 710, or 810; and a target structure 204, 304, 504, 704, or 804 comprising: a wall 208, 308, 508, 708, or 808 having a second conical structure; and a base 206, 306, 506, 706, or 806 extending radially outward from the wall 208, 308, 508, 708, or 808; wherein the first conical structure is nested or brazed on the second conical structure.

In some embodiments, the transmission target 400 or 600 comprises: a planar structure including the target material 410 or 610; and a target structure 404 or 604 comprising: a cylindrical structure 408*a* having an opening; a plate 408*b* disposed in the opening; and a base 206, 306, 406, 506, 606, 706, or 806 extending radially outward from the cylindrical structure 408*a*; wherein the planar structure is disposed or brazed on the plate 408*b*.

Some embodiments include a transmission target 200, 300, 400, 500, 600, 700, or 800, comprising: a base 206, 306, 406, 506, 606, 706, or 806; and a target material 210, 310, 410, 510, 610, 710, or 810 disposed on the base 206, 306, 406, 506, 606, 706, or 806 and including a major surface 210*a*, 310*a*, 410*a*, 510*a*, 610*a*, 710*a*, or 810*a* disposed at an angle 210*b*, 310*b*, 410*b*, 510*b*, 610*b*, 710*b*, or 810*b* relative to the base 206, 306, 406, 506, 606, 706, or 806 that is different from 89 to 91 degrees; wherein the base and the target material 210, 310, 410, 510, 610, 710, or 810 are configured to convert incident electrons from a high-power electron beam aligned with an axis into radiation where a majority of the radiation is emitted substantially along the axis.

In some embodiments, the majority of the major surface 210*a*, 310*a*, 410*a*, 510*a*, 610*a*, 710*a*, or 810*a* is disposed at an angle 210*b*, 310*b*, 410*b*, 510*b*, 610*b*, 710*b*, or 810*b* relative to the axis 202, 302, 403, or 702 that is less than 70 degrees.

In some embodiments, the target material 210, 310, 510, 710, or 810 has a conical structure.

In some embodiments, the conical structure is concave.

In some embodiments, the transmission target 400 or 600 further comprises a cylindrical structure; wherein: the base 406 or 606 extends radially outward from the cylindrical structure; and the target material 410 or 610 is disposed in the cylindrical structure.

In some embodiments, the target material 410 or 610 comprises a planar surface.

In some embodiments, the target material 610 comprises a plurality of planar surfaces.

In some embodiments, the transmission target 200, 300, 500, 600, 700, or 800 further comprises an opening between the target material 210, 310, 510, 610, 710, or 810 and the base 206, 306, 506, 606, 706, or 806.

In some embodiments, the target material 210, 310, 410, 510, 610, 710, or 810 and the base 206, 306, 406, 506, 606, 706, or 806 are formed of the same material.

Some embodiments include a transmission target, comprising: means for converting an electron beam into radiation; and means for supporting the means for converting at an angle relative to the electron beam that is different from 89 to 91 degrees.

Examples of the means for converting an electron beam into radiation include the target material 210, 310, 410, 510, 610, 710, or 810 described above.

Examples of the means for supporting include the target structure 204, 304, 404, 504, 604, 704, and 804 described above.

Although the structures, devices, methods, and systems have been described in accordance with particular embodiments, one of ordinary skill in the art will readily recognize that many variations to the particular embodiments are possible, and any variations should therefore be considered to be within the spirit and scope disclosed herein. Accordingly, many modifications may be made by one of ordinary skill in the art without departing from the spirit and scope of the appended claims.

The claims following this written disclosure are hereby expressly incorporated into the present written disclosure, with each claim standing on its own as a separate embodiment. This disclosure includes all permutations of the independent claims with their dependent claims. Moreover, additional embodiments capable of derivation from the independent and dependent claims that follow are also expressly incorporated into the present written description. These additional embodiments are determined by replacing the dependency of a given dependent claim with the phrase "any of the claims beginning with claim [x] and ending with the claim that immediately precedes this one," where the bracketed term "[x]" is replaced with the number of the most recently recited independent claim. For example, for the first claim set that begins with independent claim 1, claim 3 can depend from either of claims 1 and 2, with these separate dependencies yielding two distinct embodiments; claim 4 can depend from any one of claim 1, 2, or 3, with these separate dependencies yielding three distinct embodiments; claim 5 can depend from any one of claim 1, 2, 3, or 4, with these separate dependencies yielding four distinct embodiments; and so on.

Recitation in the claims of the term "first" with respect to a feature or element does not necessarily imply the existence of a second or additional such feature or element. Elements specifically recited in means-plus-function format, if any, are intended to be construed to cover the corresponding structure, material, or acts described herein and equivalents thereof in accordance with 35 U.S.C. § 112 ¶ 6. Embodiments of the invention in which an exclusive property or privilege is claimed are defined as follows.

The invention claimed is:

1. A system, comprising:
an electron source configured to generate an electron beam along an axis; and
a transmission target configured to receive the electron beam, the transmission target, comprising:
a radially extending base;
a wall attached to and extending radially and axially from the radially extending base;
a target material disposed on a side of the wall opposite to the radially extending base and configured to receive the electron beam;
wherein the radially extending base and the wall are disposed to form an opening between the wall and the radially extending base that increases in length along the axis as a radial distance from the axis increases;
wherein a majority of the target material is disposed forming a concave surface and a majority of the concave surface is disposed at an angle relative to the axis different from 89 to 91 degrees.

2. The system of claim 1, wherein the majority of the concave surface is disposed at an angle relative to the axis that is less than 70 degrees.

3. The system of claim 1, wherein the transmission target has a conical structure and the concave surface is an inner surface of the conical structure.

4. The system of claim 1, wherein the angle of the concave surface of the transmission target increases as the distance from the axis increases.

5. The system of claim 1, wherein the transmission target further comprises a cylinder surrounding the target material.

6. The system of claim 5, wherein the concave surface comprises at least one plane.

7. The system of claim 1, wherein the transmission target is entirely formed of the target material.

8. The system of claim 1, wherein the transmission target comprises:
a first conical structure including the target material; and
wherein:
the wall has a second conical structure;
the first conical structure is nested on the second conical structure.

9. A transmission target, comprising:
a base radially extending relative to an axis;
a wall disposed on the base and extending radially and axially from the base; and
a target material disposed on a side of the wall opposite to the base where a majority of a surface of the target material disposed at an angle relative to the base that is different from 89 to 91 degrees;
wherein:
target material is configured to convert incident electrons from a high-power electron beam aligned with the axis into radiation where a majority of the radiation is emitted substantially along the axis; and
an opening between the base and the target material that increases in length along the axis across the majority of the surface of the target material as a radial distance from the axis increases.

10. The system of claim 9, wherein the majority of the major surface is disposed at an angle relative to the axis that is less than 70 degrees.

11. The transmission target of claim 9, wherein the target material has a conical structure.

12. The transmission target of claim 9, wherein the target material comprises a planar surface.

13. The transmission target of claim 9, wherein the target material comprises a plurality of planar surfaces.

14. The transmission target of claim 9, wherein the target material and the base are formed of the same material.

* * * * *